United States Patent [19]

Moore et al.

[11] 4,042,218

[45] Aug. 16, 1977

[54] APPARATUS FOR MIXING FLUIDS HELD IN TUBES

[75] Inventors: Robert R. Moore, Glenview; Vincent E. Eitzen, Evanston, both of Ill.

[73] Assignee: American Hospital Supply Corporation, Evanston, Ill.

[21] Appl. No.: 673,602

[22] Filed: Apr. 5, 1976

Related U.S. Application Data

[62] Division of Ser. No. 407,809, Oct. 19, 1973, Pat. No. 3,975,001.

[51] Int. Cl.[2] ..... B01F 9/02

[52] U.S. Cl. ..... 259/72; 259/81 R; 259/DIG. 20; 259/DIG. 38; 259/DIG. 44; 259/1 R; 233/26

[58] Field of Search ..... 259/72, 81 R, 89, 3, 259/12, 13, 75, 1 R, 91, DIG. 41, DIG. 42, DIG. 44, DIG. 43, DIG. 20, DIG. 38; 233/26

[56] References Cited

U.S. PATENT DOCUMENTS

| | | | |
|---|---|---|---|
| 1,863,977 | 6/1932 | Forde et al. | 259/48 |
| 2,116,367 | 5/1938 | Smith | 259/91 |
| 2,356,004 | 8/1944 | Price | 259/91 |
| 2,539,851 | 1/1951 | Massey | 259/72 |
| 3,061,280 | 10/1962 | Kraft et al. | 259/72 |

FOREIGN PATENT DOCUMENTS

| | | | |
|---|---|---|---|
| 1,210,038 | 10/1970 | United Kingdom | 233/26 |

*Primary Examiner*—William Price
*Assistant Examiner*—Joseph Man-Fu Moy
*Attorney, Agent, or Firm*—Tilton, Fallon, Lungmus, Chestnut & Hill

[57] ABSTRACT

A generally upright cylinder is secured at its upper neck by means of a gimbal mount; and its base is driven in circular motion at a substantially constant angular velocity. As a tube of fluid is inserted into the cylinder, the fluid is stirred by the motion of the cylinder; and the intensity of the stirring action increases with the depth to which the tube is inserted into the cylinder. An appliance removably attaches to the apparatus to provide a vibrating platform.

2 Claims, 8 Drawing Figures

APPARATUS FOR MIXING FLUIDS HELD IN TUBES

RELATED APPLICATION

This is a divisional application of copending application Ser. No. 407,809, filed Oct. 19, 1973, now U.S. Pat. No. 3,975,001.

BACKGROUND AND SUMMARY

The present invention relates to an apparatus for mixing fluids held in containers. Normally, this type of apparatus is used in a laboratory, and the fluids are held in test tubes. It is frequently desired to stir the fluid, for example, to mix two fluids or to evenly disperse particulate matter in a liquid medium.

One device for mixing liquids known to the prior art is disclosed in the Kraft, et al., U.S. Pat. No. 3,061,280 entitled "Apparatus for Mixing Fluent Material", issued Oct. 30, 1962. In this device, a test tube is held at its upper portion by means of a spring-type clamp which permits rotation of the lower end of the tube. The lower end of the tube is received in a deep resilient cup which is driven eccentrically by means of an electric motor. Although the apparatus disclosed in the patent cited above does not allow for variation in the intensity of stirring since the deep resilient cup is driven at constant angular velocity, nevertheless, the commercial version did provide a rheostat in the motor circuit which permitted speed control. In this commercial version, marketed under the trade name "Vortex Genie Mixer" by the owner of this application, the resilient clamp mounting for the upper neck of the test tube was also eliminated; and the holder for the tube was modified from a deep plastic form holder to a shallow rubber cup. In operating this commercial device, a person held the test tube with one hand and placed the bottom of the tube into the shallow cup. He then pressed a switch which energized the motor, and, if desired, operated the rheostat to achieve the desired stirring speed.

It will be appreciated that more energy is normally required to start a true vortex of the fluid than is required to continue the stirring once it is started. That is, once the inertia of the fluid is overcome, unless the stirring energy is decreased, the fluid vortex may climb the side of the test tube and even spill over.

One of the disadvantages of this last-named system is that it requires two hands to operate—one to control the speed of rotation (by varying a rheostat), and the other to hold the tube in place. Speed control of a shaded pole induction motor by means of a rheostat is not positive, and the speed varies with the load on the motor for any given setting. Further, since the fluid vortex has a tendency to climb the walls of the test tube suddenly, once started, spillage has occurred. The possibility of spillage is further increased because the machine is normally turned on without adjusting the speed, and the speed at which it has been set may be too high for the viscosity and quantity of fluid desired to be stirred. In addition, pressing on the test tube causes a loading of the drive motor with resultant lowering of the mixing speed.

In one embodiment, the present invention provides an elongated cylinder mounted in a generally upright position by means of a gimbal mount located toward the top of the cylinder. The gimbal mount permits unrestricted rotation of the bottom of the cylinder which is driven by an eccentric drive. A receptacle is slidably mounted within the cylinder, and biased to an upward position by means of a coil spring. A switch is located in a position adjacent the gimbal mount, and it is actuated when a test tube containing fluids desired to be mixed is inserted into the cylinder and pressed downwardly to lower the receptacle against the action of the coil spring. When the switch is actuated, it starts a motor which then drives the base of the cylinder in circular motion at a constant angular velocity.

The axis of the cylinder can therefore be thought of as forming a conical surface as it rotates; and as the test tube is further lowered into the cylinder, held by the receptacle or cup, the intensity of the stirring motion increases because the circumference through which the base of the test tube is rotated enlarges, according to the shape of the cone formed by the axis of the cylinder, as just described. Hence, the intensity of the stirring action can be controlled simply by moving the test tube axially of the cylinder.

The present invention eliminates the need for a speed control mechanism in the drive motor while providing a smooth, controllable and predictable variation in stirring intensity. Constant stirring speed is quickly achieved, and the stirring intensity may be reduced by withdrawing the test tube slightly with the motion of a single hand. The possibility of spillage is thus greatly reduced and overall control is smoother and achieved with only one hand.

Another feature of the present invention is that the cup for holding the test tube is provided with a generally conical surface on which the test tube is seated; and the lower portion of this conical surface is provided with an aperture. The interior of the cylinder may be cleaned by introducing a cleaning solution through the hole and pumping the solution through the cylinder and a flexible conduit which couples any fluid in the cylinder outside the device.

Another feature of the present invention is that pressing down firmly on the test tube does not load the motor significantly—it merely lowers the receptacle for the test tube down into the driven cylinder and increase the intensity of the stirring action. That is to say, it does not load the motor to slow it down, as with the device mentioned.

With the present invention then, stirring action is initiated by placing a test tube into the cup at the top of the cylinder and lowering it. Downward displacement of the cup actuates a switch which drives the base of the cylinder in rotary motion at constant angular velocity. The top of the cylinder is constrained by the gimbal mount. As the test tube is inserted more deeply into the cylinder, a vortex will be formed by the fluid in the tube. The intensity of the stirring action may be increased if the test tube is lowered further; and conversely, as it is withdrawn, the intensity of the stirring action abates until the cup reaches its original position and turns off the drive motor. All control is thus achieved with a single hand motion.

An appliance is also disclosed which may be attached to the apparatus and easily removed for providing a vibrating platform, if desired.

THE DRAWING

DETAILED DESCRIPTION

Figure 1:
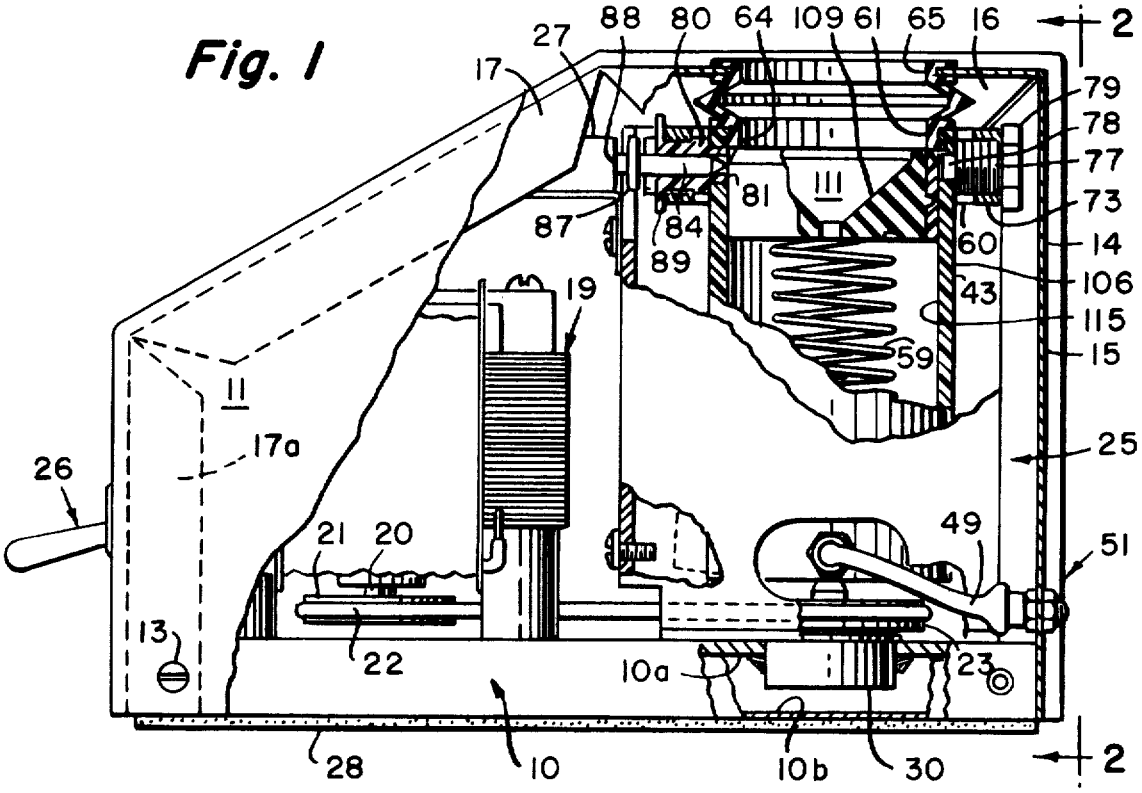
FIG. 1 is a side elevation view, partially broken away, of apparatus incorporating the present invention.
Figure 2:
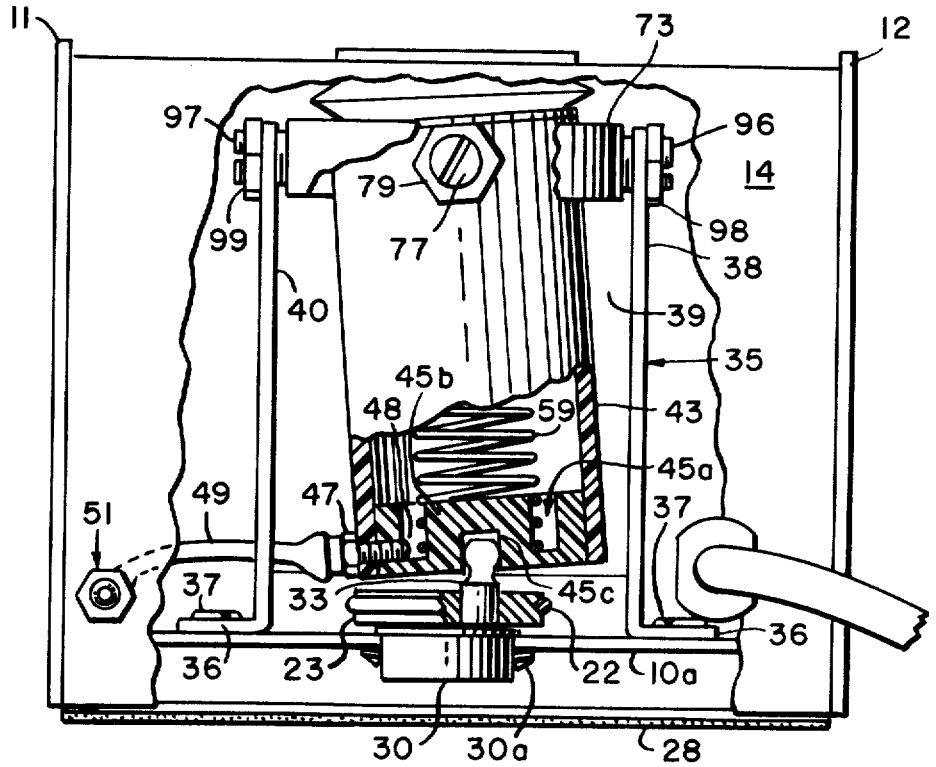
FIG. 2 is a rear elevation view, again partially broken away, of the apparatus of FIG. 1 taken along the sight line 2—2.

Referring first to FIGS. 1 and 2, the apparatus of the present invention includes a base generally designated 10 to which first and second side panels 11 and 12 are mounted by means of machine screws, one of which is shown at 13. The base 10 is fabricated from an upper plate 10*a* and a lower plate 10*b*, as best seen in FIG. 1. The upper plate 10*a* is formed into an inverted U-shape (as view in cross section in a plane perpendicular to the plane of the page of FIG. 1) with depending side flanges. The lower plate is formed into an upright U-shape with upright side flanges adjacent a corresponding flange of the upper plate. The back, top and front of the device are enclosed by means of a sheet metal case 14 which is provided with corresponding inwardly turned flanges as at 15, 16, 17 and 17*a* on each side for securing the case 14 to the side panels 11, 12.

A shaded pole electric motor generally designated by reference numeral 19 is mounted to the top of the base plate 10, and it includes a downwardly extending shaft 20 which is fitted with a pulley 21. A flexible belt of round cross section designated 22 is fitted on the pulley 21 and on a corresponding drive cam 23 which is rotatably mounted in the base 10 beneath a chassis assembly generally designated by reference numeral 25.

The motor 19 is a conventional shaded pole motor operating on normal 120 volt, 60 hertz supply, and having a nominal speed of 3300 revolutions per mimute. It is energized when two switches, which may be connected in series, are closed. One of the switches is a conventional toggle switch, generally designated by reference numeral 26 and accessible to an operator of the apparatus; and the other switch is a limit switch 27 housed within the device and explained more fully below. In normal operation, the toggle switch 26 is left in the "on" position, and it is the limit switch 27 which acts to turn the motor 19 on and off.

In order to eliminate movement of the device during operation, an adhesive-backed pad 28 of sponge rubber is secured to the bottom surface of the base plate 10.

Figure 3:
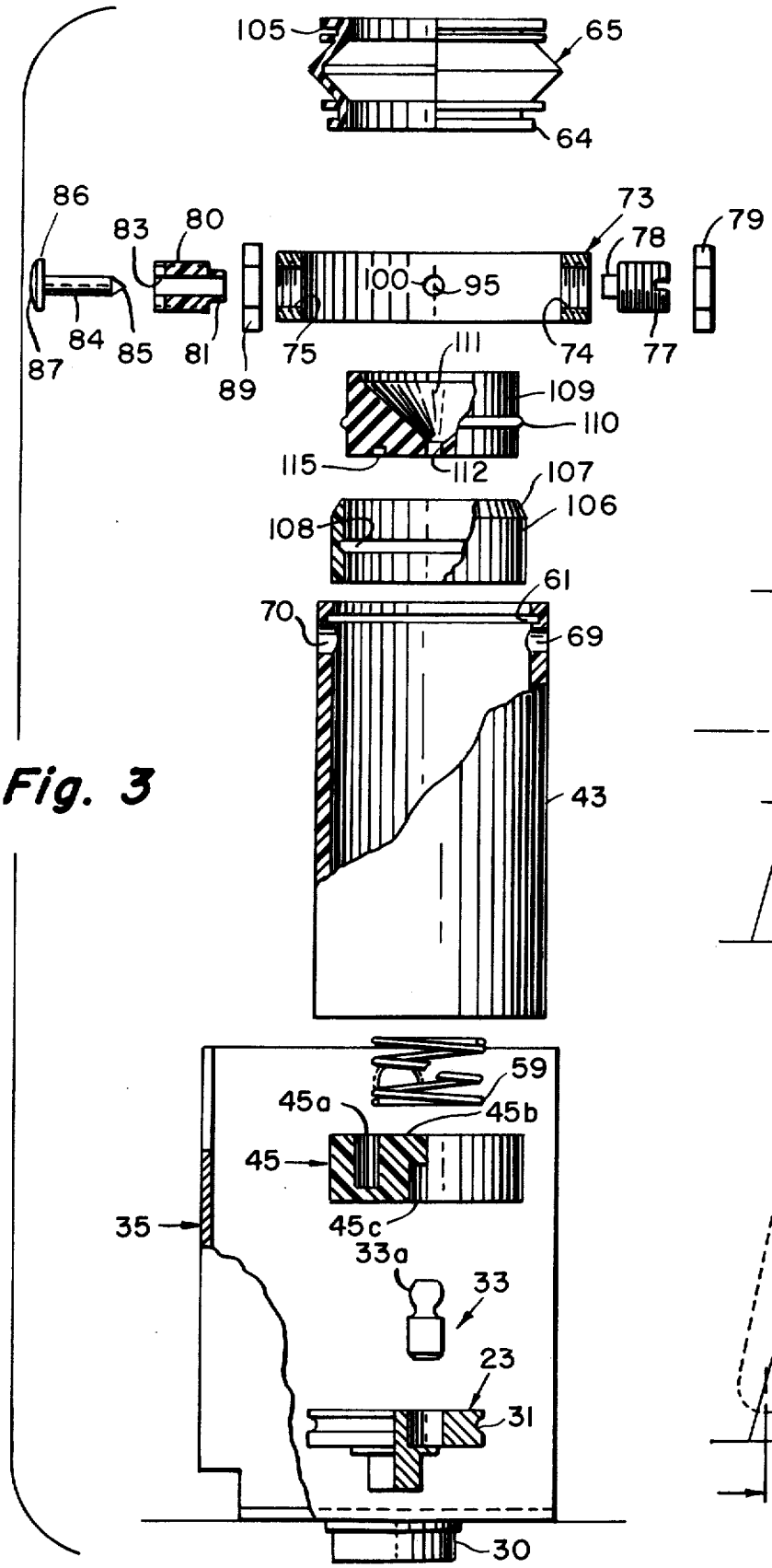
FIG. 3 is a side exploded view of the chassis assembly of the apparatus of FIG. 1, again with certain elements partially broken away or in cross section for clarity.

The drive cam 23 is rotatably received in a bearing 30 which is mounted to the upper plate 10*a* of the base 10 by a retainer 30*a*. As best seen in FIGS. 2 and 3, the drive cam 23 has a peripheral groove 31 which receives the drive belt 22, and it is provided with a drive ball 33 having an axis parallel to the axis of rotation of drive cam 23, but offset therefrom to pro vide an eccentric drive when it is driven by the motor 19. The upper portion of ball 33 is rounded as at 33*a* to provide a low friction ball drive.

Turning now to the chassis assembly 25, a three-sided bracket or chassis 35 is provided with lower outwardly extending flanges 36 for mounting to the top plate 10*a* of the base plate 10 by means of screws 37. The three upright sides of the chassis 35 are designated respectively 38, 39 and 40 in FIG. 2; and the side 39 is generally perpendicular to the other two sides.

Housed within the chassis 35 and supported by it is a hollow cylinder or tube 43. A tube base 45 is secured to the bottom of the tube 43. Preferably, both the tube 43 and the base 45 are made of plastic; and they may either be molded as one piece or the base may be secured in place by a suitable adhesive. The base 45 has an upper annular groove 45*a* which surrounds a central pedestal 45*b* (FIG. 2). A hole 45*c* is formed beneath the pedestal 45*b* to form a bearing surface for the rounded upper portion of the ball 33.

An externally threaded hollow drain fitting 47 having an aperture 48 is located to communicate through the cylindrical wall 43 and base 45 with the bottom of the annular groove 45*a* so any fluids within the cylinder can be drained out of the apparatus by means of a flexible conduit 49 (FIG. 1) connected between the drain fitting 47 and a second drain fitting generally designated 51 mounted to the rear portion of the casing 14.

The lower portion of a coil spring 59 is seated about the outer surface of the pedestal 45*b*, as best seen in FIG. 2. Turning now to the upper portion of the cylinder or tube 43, it is provided with a groove 61 to seat the lower peripheral lip 64 of a flexible bellows 65, as best seen in FIG. 1. The top of the cylinder 43 also includes a first side aperture 69 and a large side aperture 70 located at diametrically opposite positions.

The top of cylinder 43 is pivotally mounted to a gimbal ring generally designated by reference numeral 73. The gimbal ring 73 includes first and second diametrically opposite internally threaded apertures 74 and 75 which align respectively will the aperture 69 and 70 of the cylinder 43. An externally threaded set screw 77 having an inner stub 78 is received in the side aperture 74 of the gimbal ring 73 with the stub 78 extending into the aperture 69 of the cylinder 43; and it is held there by means of a lock nut 79 (see FIG. 1). Similarly, a set screw 80 provided with a second stub shaft 81 is received in the opposite aperture 75 of the gimbal ring 73 with the stub 81 extending into the aperture 70 of the cylinder 43.

Referring to FIG. 3, the set screw 80 has an axial bore 83 for slidably receiving the smooth shaft of a switch actuator pin 84, the inner end of which is provided with a rounded point 85 and the outer end of which is provided with a head 86. The outer surface of the head 86 is designated 87; and it is formed as a portion of a larger sphere, as will be explained in greater detail below. The surface 87 engages a plunger 88 (FIG. 1) of the switch 27. The set screw 80 is held in position by means of a lock nut 89.

The cylinder 43 is pivotally movable on the stub shafts 78 and 81. When so moved, the bottom of cylinder 43, of course, swings inwardly and outwardly of the plane of the page of FIG. 3 along a horizontal axis which is co-axial with the shaft of the switch actuator pin 84.

The gimbal ring 73, on the other hand, is pivotally rotatable about an axis extending transverse of the one just mentioned and intersecting with it at the point designated 95 in FIG. 3. As best seen in FIG. 2, the gimbal ring 73 is supported by first and second set screws 96 and 97 received in the side plates 38, 40 of the bracket 35 and held by means of lock nuts 98 and 99 respectively. Each of the set screws 96, 97 is similar to the previously described set screws 77, having inner bearing stubs which are rotatably received in corresponding apertures in the gimbal ring 73, one such aperture being designated 100 in FIG. 3.

The bellows 65 is molded of resilient material, such as neoprene rubber, and it includes an upper peripheral groove 105 which fits over a corresponding aperture in the top of the panel 14 where it is held. When assembled, the bellows 65 is slightly compressed.

Slidably received with the cylinder 43 is a cup sleeve 106 having an upper beveled edge 107 and an interior peripheral groove 108. The cup sleeve 106 is preferably made of plastic; and it holds a molded cup 109. The cup 109 is provided with an integral exterior ridge or bead 110 which is received in the groove 108 of the sleeve 106 when the two are assembled. The cup 109 is also provided with an upwardly opening conical seating surface 111 which receives the base of a test tube or container desired to be stirred. The bottom of the cylindrical surface 111 leads into an opening 112 which communicates with the interior of the cylinder 43. Any liquids (such as for cleaning or as will occasionally be accidentally spilled) which are introduced into the cup 109 are funneled by means of the conical surface 111 and the aperture 112 to the interior of the cylinder 43 where they then flow through the aperture 48 in the tube base 45 and through the drain fitting 47, as previously described.

The bottom of the cup 109 is further provided with an annular groove 115 which receives the top of the coil spring 59, as best seen in FIG. 1.

OPERATION

When it is desired to stir fluid materials in a test tube or other container, the bottom of the tube is lowered through the upper opening defined by the bellows 65, as best seen in FIG. 1, until the bottom of the container engages the conical surface 111 of the cup 109. The inverted conical shape of the surface 111 accommodates tubes of different diameter while maintaining an ability to urge the tube laterally to achieve a stirring motion. However, stirring does not begin until the tube is urged downwardly, causing the cup 109 and its associated cup sleeve 106 to compress the coil spring 59, and to permit the switch actuator pin 84 to move radially inward of the cylinder 43.

The switch plunger 88 is spring-biased outwardly, and it is a normally closed switch. Hence, when the cup 109 is lowered beyond the location of the actuator pin 84, the pin will move inwardly through the bore 83 of the set screw 80 and into the aperture 70 of the container 43, under urging of the switch plunger 88. When the switch 27, closes, the motor 19 is energized (since the switch 26 is normally on), thereby actuating the eccentric drive of the lower portion of the container 43. That is to say, the pulley 22 rotates the drive cam 23; and the eccentrically mounted drive ball 33 is driven in circular motion with the drive cam 23. This, in turn, drives the bottom plate 45 of the container 43 in circular motion at substantially angular velocity, as determined by the motor characteristics.

The upper portion of the cylinder 43, of course, held by the gimbal mounting means including the gimbal ring 73 which pivotally supports the upper portion of the cylinder 43 for pivotal motion about a first horizontal axis, and is itself pivotally connected to the bracket 35 for pivotal motion about a second horizontal axis transverse to the first horizontal axis.

As long as the switch 27 remains closed, the eccentric drive will continue to rotate the lower portion of the cylinder 43 at a substantially constant angular velocity.

Figure 4:
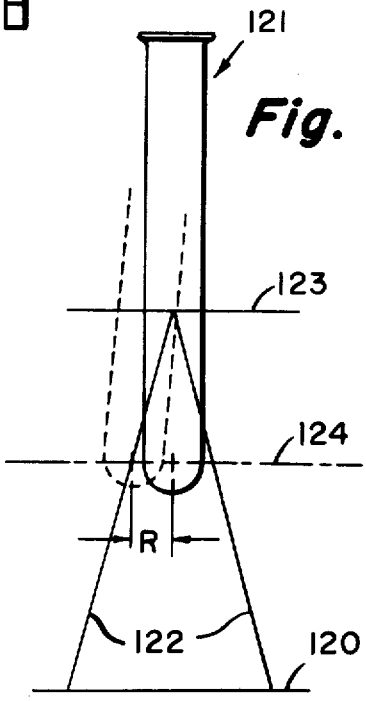
FIGS. 4 and 5 are diagrammatic views illustrating the intensity of stirring action as a function of the depth to which the tube is inserted.
Figure 5:
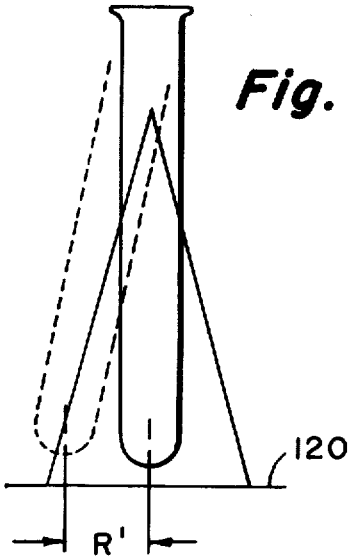

Turning now to FIGS. 4 and 5, there are shown two diagrammatic views illustrating how the intensity of the stirring action may be varied. Reference numeral 120 designates a horizontal line which may schematically represent the drive base or a plane beyond which the test tube 121 may not be lowered. Lines 122 form the edges of idealized inverted V-shape representing the conical locus of the center of the lower portion of the test tube 121. The line 123 represents the horizontal plane containing the two transverse axes of the upper gimbal mounting means for the cylinder 43.

As the tube 121 is lowered into the cylinder 43 and the drive motor actuated, the bottom of the tube will be rotated in a circle defined by the cone 122. However, a vortex is not formed by the fluid immediately. Rather, the tube must be lowered until the bottom of the tube reaches the position shown in FIG. 4, for example the chain line 124, at which the radius of the circle of rotation of the center of the tube is defined by R. Once the vortex is achieved, the fluid has a tendency to "climb" the wall of the tube, and the intensity of stirring may quickly and easily be reduced by raising the tube to reduce the radius of rotation and, hence, the amplitude or intensity of the stirring motion. If the tube 121 is lowered further from the position of FIG. 4, the radius of rotation is defined by R', for the position shown in FIG. 5; and the intensity of stirring will increase even though the base is driven in constant angular velocity. The illustrations of FIGS. 4 and 5 are idealized schematics for clarity of illustrating the principle.

It will be observed that the adjustment of stirring intensity just described is accomplished easily with only a single hand motion, and greatly reduces the tendency to spill the liquid once a vortex is started. Further, the adjustment of intensity is continuous over the design range; and the load on the motor remains substantially constant over the entire range.

The actuator pin 84 is moved as an in egral portion of the gimbal mount during operation. Hence, the spherical surface 87 on the head of the actuator 84 is formed as a portion of a sphere centered at the intersection of the transverse axes of motion of the gimbal mount. This preserves a constant spacing between the center of these axes and the contact point for the plunger 88 of the switch 27, thereby exerting a constant force on the plunger 88 and increasing its useful life. It will also be observed that the axis of the shank of the pin 84 lies along one of the transverse axes of motion of the gimbal mount, namely the one parallel to the plane of the page of FIG. 3. This minimizes the motion of the actuator pin 84, and makes the resultant motion symmetrical.

When it is desired to stop the stirring action, the test tube 121 is removed, and the spring 59 will return the cup 109 to its uppermost position. The canted outer edge 107 of the cup sleeve 106 will then engage the point 85 of the actuator 84, and acting as a ramp, move it leftward in FIG. 1 to open the normally closed switch 27.

It will thus be appreciated that the present invention provides a system which permits varying of the intensity of the stirring action for fluids in a container while, at the same time, affording the simplicity of a constant speed drive and eliminating load variations on the driving motor.

Any cleaning liquid that may be used on the apparatus will not enter the motor space since the bellows 65 seals the top of the cylinder 43 with the case 14. Any fluid introduced within the cup 109 will flow through the lower aperture 112 and be drained by means of the flexible conduit 49, as already described. It will also be appreciated that by applying a cleaning fluid into the cup 109, it will enter the interior of the cylinder 43, and it may be pumped out of the conduit 49 by covering the aperture 112 (with an empty test tube, for example) and pumping the cup 109 vertically.

Figure 6:
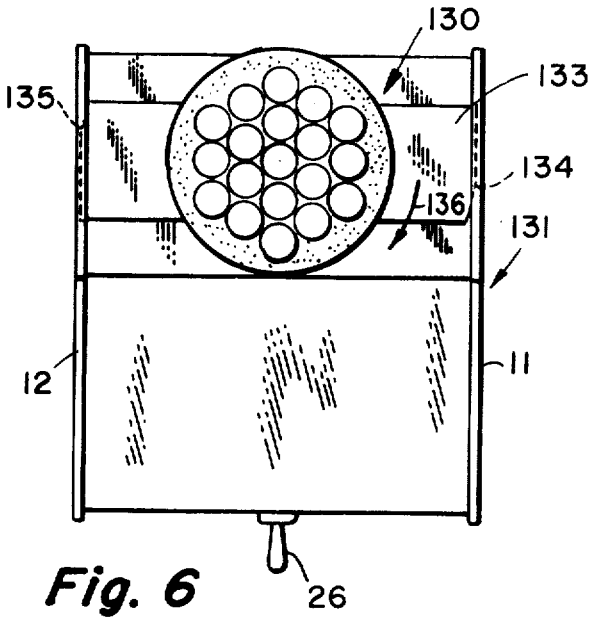
FIG. 6 is a plan view of the apparatus with an appliance attached for providing a vibrating platform.
Figure 7:
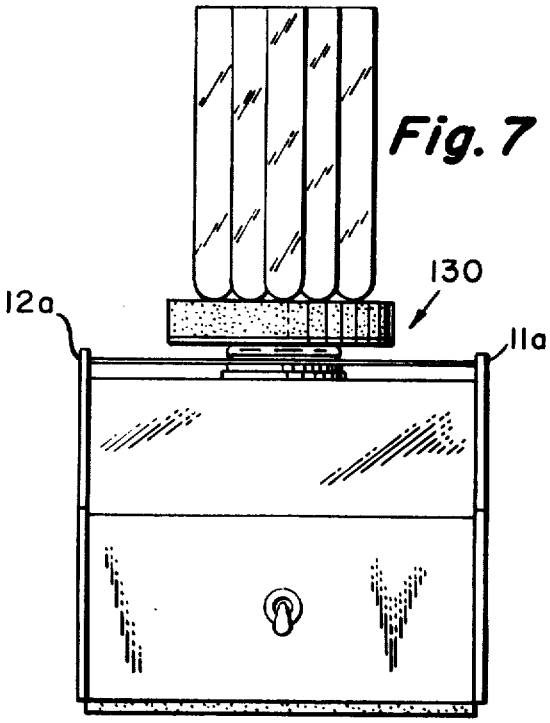
FIG. 7 is a front view of FIG. 6.
Figure 8:
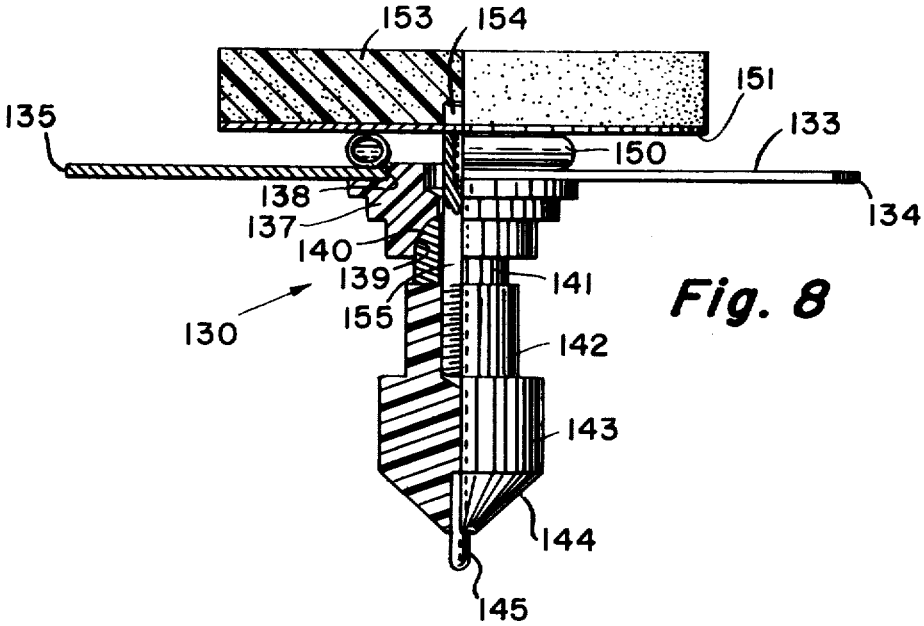
FIG. 8 is a side view, partially in cross section of the appliance.

Turning now to FIGS. 6–8, the apparatus described above is shown in combination with an appliance generally designated by reference numeral 130 which provides a vibrating platform. The apparatus is generally designated by reference numeral 130, and it may be identical to that which has already been disclosed except that the side plates 11 and 12 have upward extensions 11*a* and 12*a* respectively (see FIG. 7). Each of these upward extensions is provided with a groove for receiving respectively the ends of a wing bracket 133. The ends of the wing bracket are curved as at 134 and 135 so that as the wing bracket is turned clockwise in the direction of the arrow 136 in FIG. 6, the curved ends 134, 135 will engage the innermost walls in the grooves in the extensions 11*a,* 12*a* and become locked. When the wing bracket 133 is rotated counterclockwise, the appliance 130 becomes unlocked and may be removed, as will become apparent.

Turning now to FIG. 8, the appliance 130 is provided with a socket member 137 which is received in a central aperture 138 of the wing bracket 133 and secured to that wing bracket. The socket member 137 is provided with a spherical surface 139 which engages a corresponding surface 140 of a ball member 141. The ball member 141 may be metal whereas the socket member 137 may be plastic so as to provide a low-friction interface.

To the lower end of the ball member 141 there is attached an insert 142 provided with a lower portion 143 including a conical surface 144 shaped to be received in the receptacle or cup 109 so that the conical surface 144 of the appliance engages the corresponding conical surface 111 of the cup 109. A pin 145 protrudes through the aperture 112 of the cup 109 when the appliance is attached to the apparatus.

Located above the wing bracket 133 is a flexible tube 150 formed in the shape of a circle about the aperture 138 and sealed between the upper surface of the bracket 133 and the lower surface of a disk-shaped platform base 151. A layer of resilient material such as foam rubber or foam plastic 153 is attached to the top of the platform base 151; and the platform base 151 is secured to the insert 142 by means of a bolt 154 and an extension 155 threaded into the insert 142.

When the appliance 130 is assembled to the apparatus 131, the main toggle switch 126 is used to operate the device by an operator. That is, as the insert 142 is lowered into the tubular housing 43, the cup 109 is displaced from its rest position, and the switch 27 is closed as long as the appliance is assembled to the apparatus.

When the switch 26 is turned on, the insert 142 is driven by the cup 109; and the platform comprising the base 151 and voering layer 153 is thereby vibrated.

The platform appliance best described is useful for stirring fluids held in different types of laboratory containers, such as flat-bottom measuring tubes, flasks, and other containers having large or flat bottoms. It is further useful if it is desired to simultaneously stir a number of test tubes as illustrated in FIGS. 6 and 7. Frequently it is desired by laboratory personnel to simultaneously stir a number of smaller test tubes which are not easily handled singly, and require only a small amount of vibratory motion to impart stirring.

Having thus described in detail a preferred embodiment of the present invention, persons skilled in the art will be able to modify certain of the structure which has been illustrated and to substitute equivalents for those disclosed while continuing to practice the principle of the invention. It is therefore intended that all such modifications and substitutions be covered as they are embraced within the spirit and scope of the appended claims.

We claim:

1. In combination, apparatus for varying the intensity of stirring motion of a fluid in a container such as a test tube including outer casing means; a generally upright tubular housing; cup means slidably recieved in said housing; spring means resiliently urging said cup means to an upper position within said housing; drive means for driving the lower portion of said housing in orbital motion; and gimbal mounting means for mounting the upper portion of said housing; and an appliance removably attachable to said apparatus and comprising bracket means (for movably attaching to said apparatus) removably secured to said casing means; an insert carried by said bracket means and universally movable relative thereto for insertion into said cup means when said bracket means is assembled to said (apparatus) casing means; and a platform connected to said insert and (rotated thereby, as said insert is rotated when said cup is driven in rotary motion) vibrated by said insert as said housing is driven.

2. The apparatus of claim 1 wherein said appliance further comprises socket means secured to said bracket means and providing a spherical concave surface; a ball member attached to said insert and defining a spherical surface engaging the concave surface of said socket member; said insert extending beneath said bracket means when said bracket means is assembled to said apparatus, said platform being located above said bracket means when said bracket means is assembled to said casing means.

* * * * *